US009981674B1

(12) United States Patent
Palmer et al.

(10) Patent No.: US 9,981,674 B1
(45) **Date of Patent: *May 29, 2018**

(54) SYSTEM AND METHOD FOR AGGREGATION DISPLAY AND ANALYSIS OF RAIL VEHICLE EVENT INFORMATION

(71) Applicant: SMARTDRIVE SYSTEMS, INC., San Diego, CA (US)

(72) Inventors: Jason Palmer, Carlsbad, CA (US); Slaven Sljivar, San Diego, CA (US); Mark Freitas, San Diego, CA (US); Daniel A. Deninger, Carlsbad, CA (US); Shahriar Ravari, San Diego, CA (US)

(73) Assignee: SmartDrive Systems, Inc., San Diego, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/346,479

(22) Filed: Nov. 8, 2016

Related U.S. Application Data

(63) Continuation of application No. 14/592,245, filed on Jan. 8, 2015, now Pat. No. 9,487,222.

(51) Int. Cl.
*B61L 25/02* (2006.01)
*B61K 9/00* (2006.01)
(Continued)

(52) U.S. Cl.
CPC ..... *B61L 25/02* (2013.01); *B61L 15/009* (2013.01); *B61L 15/0081* (2013.01);
(Continued)

(58) Field of Classification Search
CPC ..... G09B 9/042; G09B 9/04; B60Q 1/444; G07C 5/008; G07C 5/0808; G07C 5/10;
(Continued)

(56) References Cited

U.S. PATENT DOCUMENTS 5,505,076 A 4/1996 Parkman
5,883,337 A 3/1999 Dolan
(Continued)

FOREIGN PATENT DOCUMENTS

CA 1126093 6/1982
CA 1126093 A 6/1982
(Continued)

OTHER PUBLICATIONS

Mortlock, "Automatic Train Control: Concept of System," Jun. 28, 2010 Retrieved from http://ww.hsr.ca.gove/docs/programs/eir_memos/Proj_Guidelines_TM3_3_1R00.pdf (64 pages).
(Continued)

*Primary Examiner* — Yuri Kan
(74) *Attorney, Agent, or Firm* — Sheppard Mullin Richter & Hampton LLP

(57) ABSTRACT

This disclosure relates to a rail vehicle event analysis system configured to facilitate analysis of rail vehicle event records that correspond to rail vehicle events. The system may be configured to visually present a user with information related to operation of a rail vehicle. The user may review the information related to operation of the rail vehicle in real time, responsive to the rail vehicle being involved in a rail vehicle event, and/or at other times. The system may be configured to visually present information based on output signals generated by one or more sensors associated with the rail vehicle. The system may synchronize the presented information such that information from individual sensors may be compared and/or viewed at the same time by the user. The system may be configured to receive observations made by the user based on the user's review of the presented visual information.

17 Claims, 6 Drawing Sheets

(51) Int. Cl.

| | |
|---|---|
| ***G09B 9/04*** | (2006.01) |
| ***B61L 27/00*** | (2006.01) |
| ***B61L 15/00*** | (2006.01) |
| ***B61L 23/34*** | (2006.01) |

(52) U.S. Cl.
CPC ..... *B61L 23/34* (2013.01); *B61L 27/0011* (2013.01); *B61L 27/0094* (2013.01)

(58) Field of Classification Search
CPC ..... B60W 30/18172; B61F 5/22; B61F 1/043; B60L 7/22; B60G 17/02; B61L 27/0094; B61L 25/02; B61L 27/00; B61K 9/00
USPC ..... 701/29, 29.3, 33.4, 93, 1, 19; 434/66; 340/479; 105/72.2, 199.1, 35, 453
See application file for complete search history.

(56) References Cited

U.S. PATENT DOCUMENTS

| | | | | |
|---|---|---|---|---|
| 5,956,664 | A | 9/1999 | Bryan | |
| 5,995,881 | A | 11/1999 | Kull | |
| 6,526,352 | B1 | 2/2003 | Breed | |
| 6,553,308 | B1 | 4/2003 | Uhlmann | |
| 7,027,621 | B1 | 4/2006 | Prokoski | |
| 7,398,140 | B2 | 7/2008 | Kemwein | |
| 7,698,028 | B1 | 4/2010 | Bilodeau | |
| 8,892,310 | B1 | 11/2014 | Palmer | |
| 9,296,401 | B1 | 3/2016 | Palmer | |
| 2004/0015276 | A1 | 1/2004 | Kane | |
| 2005/0107954 | A1 | 5/2005 | Nahla | |
| 2005/0183627 | A1* | 8/2005 | Hommen | B60G 17/02 105/453 |
| 2005/0205719 | A1 | 9/2005 | Hendrickson | |
| 2005/0251337 | A1 | 11/2005 | Rajaram | |
| 2006/0098843 | A1 | 5/2006 | Chew | |
| 2006/0244830 | A1 | 11/2006 | Davenport | |
| 2007/0040672 | A1 | 2/2007 | Chinigo | |
| 2007/0136078 | A1 | 6/2007 | Plante | |
| 2007/0216771 | A1 | 9/2007 | Kumar | |
| 2007/0217670 | A1 | 9/2007 | Bar-Am | |
| 2007/0241874 | A1* | 10/2007 | Okpysh | B60Q 1/444 340/479 |
| 2007/0257804 | A1 | 11/2007 | Gunderson | |
| 2007/0272116 | A1* | 11/2007 | Bartley | B60L 7/22 105/35 |
| 2008/0147267 | A1* | 6/2008 | Plante | G07C 5/008 701/33.4 |
| 2010/0094489 | A1 | 4/2010 | Moffitt | |
| 2010/0204857 | A1* | 8/2010 | Forrest | B61L 27/0094 701/19 |
| 2010/0241296 | A1 | 9/2010 | Rhea | |
| 2010/0327125 | A1 | 12/2010 | Braband | |
| 2011/0216200 | A1 | 9/2011 | Chung | |
| 2011/0285842 | A1 | 11/2011 | Davenport | |
| 2012/0021386 | A1* | 1/2012 | Anderson | G09B 9/042 434/66 |
| 2012/0072088 | A1 | 3/2012 | Cutright | |
| 2012/0130563 | A1 | 5/2012 | McBain | |
| 2012/0203402 | A1 | 8/2012 | Jape | |
| 2012/0245908 | A1 | 9/2012 | Berggren | |
| 2012/0269383 | A1 | 11/2012 | Babbitt | |
| 2013/0018534 | A1 | 1/2013 | Hilleary | |
| 2013/0032054 | A1* | 2/2013 | Schneider | B61F 5/22 105/199.1 |
| 2013/0046421 | A1 | 2/2013 | ElFassi | |
| 2013/0048795 | A1 | 2/2013 | Cross | |
| 2014/0012438 | A1 | 1/2014 | Shoppa | |
| 2014/0047371 | A1 | 2/2014 | Palmer | |
| 2014/0052315 | A1 | 2/2014 | Isailovski | |
| 2014/0257594 | A1* | 9/2014 | Hashimoto | G07C 5/10 701/1 |
| 2014/0339374 | A1 | 11/2014 | Mian | |
| 2015/0000415 | A1 | 1/2015 | Kelley | |
| 2015/0202935 | A1* | 7/2015 | Muthusamy | B60F 1/043 105/72.2 |
| 2015/0203116 | A1* | 7/2015 | Fairgrieve | B60W 30/18172 701/93 |
| 2015/0371462 | A1* | 12/2015 | Ramesh | G07C 5/0808 701/29.3 |
| 2016/0114820 | A1 | 4/2016 | Palmer | |
| 2016/0140872 | A1 | 5/2016 | Palmer | |
| 2016/0200330 | A1 | 7/2016 | Palmer | |
| 2016/0200333 | A1 | 7/2016 | Palmer | |
| 2016/0292936 | A1 | 10/2016 | Palmer | |

FOREIGN PATENT DOCUMENTS

| | | | |
|---|---|---|---|
| EP | 1115092 | A1 | 7/2001 |
| EP | 1825339 | | 8/2007 |
| WO | 2005095175 | A1 | 10/2005 |
| WO | 2005118366 | | 12/2005 |
| WO | 2006125256 | | 11/2006 |
| WO | 2006125256 | A1 | 11/2006 |
| WO | 2013134615 | A1 | 9/2013 |

OTHER PUBLICATIONS

PCT International Search Report and Written Opinion for PCT/US2015/066873, dated Feb. 19, 2016 (17 pages).
PCT International Search Report and Written Opinion for PCT/US2016/012757 dated Mar. 18, 2016 (7 pages).
European Search Report EP16150325.5 dated May 19, 2016 (13 pages).
PCT International Search Report and Written Opinion for PCT/US2016/012757 dated Mar. 18, 2016.

* cited by examiner

SYSTEM AND METHOD FOR AGGREGATION DISPLAY AND ANALYSIS OF RAIL VEHICLE EVENT INFORMATION

FIELD

This disclosure relates to a rail vehicle event analysis system configured to facilitate analysis of rail vehicle event records that correspond to rail vehicle events.

BACKGROUND

Typically, trains are not equipped with vehicle event detection systems. Some trains are equipped with cameras but these cameras are usually only used for surveillance purposes to monitor interior passenger compartments. The cameras are not connected to mechanical and/or safety subsystems of the train in any way. The recorded video information from such cameras is typically viewed via a multi-media player configured to play back audio and video. The multi-media players typically include controls for playing, rewinding, fast-forwarding, and pausing the video.

SUMMARY

One aspect of this disclosure relates to a system configured to facilitate analysis of rail vehicle event records that correspond to rail vehicle events. The system is configured to synchronize rail vehicle operation information. In some implementations, synchronizing may include receiving rail vehicle operation information, detecting rail vehicle events, associating rail vehicle operation information to create vehicle event records, synchronizing the vehicle operation information in a vehicle event record, presenting the synchronized rail vehicle operation information to a user, receiving observations made by a reviewer, associating the observations with the vehicle event record, and/or other synchronization.

Rail vehicle operation information may be received via output signals generated by sensors coupled with a rail vehicle and/or other sources of information. The sensors may include, for example, a first sensor that generates a first output signal conveying first operation information, and a second sensor that generates a second output signal conveying second operation information. Examples of the one or more sensors may include a video camera, a rail vehicle safety system sensor, a rail vehicle mechanical system sensor, a rail vehicle electrical system sensor, an accelerometer, a gyroscope, a geolocation sensor, a radar detector, and/or other sensors.

Receiving rail vehicle operation information may include receiving acquired visual information that represents an environment about the rail vehicle. The environment about the rail vehicle may include areas in or near an interior and an exterior of the rail vehicle. In some implementations, receiving rail vehicle operation information may include receiving rail vehicle location information that indicates a physical geographic location of the rail vehicle from one or more system location sensors that are coupled with the rail vehicle and/or one or more non-system location sensors that are not coupled with the rail vehicle.

The rail vehicle events may be detected based on the received rail vehicle operation information, parameters determined based on the received rail vehicle operation information, pre-determined rail vehicle event criteria sets, and/or other information. The rail vehicle events may be detected, for example, by comparing the determined parameters to the criteria sets such that an individual rail vehicle event is detected responsive to the determined parameters satisfying a criteria set for the individual rail vehicle event. In some implementations, an individual rail vehicle event may have a start time and an end time. In some implementations, an individual rail vehicle event may be related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, activation of an automatic train protection (ATP) bypass, a high horn, Positive Train Control (PTC), Communications-Based Train Control (CBTC), and or other rail vehicle events.

Rail vehicle operation information from different sensors may be associated to create vehicle event records. In some implementations, information from two or more of the output signals generated during an individual vehicle event may be associated to create a vehicle event record. The rail vehicle operation information in a vehicle event record may be synchronized. The information from the two or more output signals generated during a rail vehicle event may be synchronized based on analysis of the information conveyed by the output signals such that, for example, first operation information from the first output signal during a first rail vehicle event and second operation information from the second output signal during the first rail vehicle event is synchronized by identifying and correlating corresponding phenomena in the first output signal and the second output signal during the first rail vehicle event.

The analysis of the information conveyed by the output signals may include searching for expected phenomena in the second output signal that corresponds to timing information conveyed by the first output signal, for example. The timing information may indicate a time of day the information was generated, an order in which the information was generated, and/or other information. In some implementations, the analysis of the information conveyed by the output signals may include a determination of a rail vehicle passenger comfort score, and/or other determinations. In some implementations, the analysis of the information conveyed by the output signals may include detecting presence of pedestrians near the exterior of the rail vehicle based on the acquired visual information. In some implementations, synchronizing may include synchronizing the rail vehicle location information with the information from the two or more output signals generated during the first rail vehicle event.

The synchronized rail vehicle operation information may be presented to a user with a graphical user interface and/or other devices. In some implementations, a user may include a reviewer and/or other users. In some implementations, a view of the graphical user interface may include one or more fields that correspond to the one or more sensors, a timeline field, and/or other fields. Information presented in the one or more fields may be synchronized to a common timeline that is displayed in the timeline field. In some implementations, the graphical user interface may include a geographic map field configured to display a geographic location of the rail vehicle during the first rail vehicle event (for example) on a map.

In some implementations, one or more fields of the graphical user interface may be configured to receive entry and/or selection of one or more observations made by a reviewer based on the synchronized rail vehicle operation information presented to the reviewer. The observations may be associated with a vehicle event record. In some implementations, the vehicle events, the observations, and/or other information may be filtered based on geo-fences. Geo-fences may be virtual boundaries that define physical areas where one or more rail vehicle events are permissible or are not permissible. In some implementations, the graphical user interface may be configured to present the synchronized rail vehicle operation information to a non-rail vehicle operator user (e.g., a reviewer) and/or other users in real-time or near real-time during operation of the rail vehicle. In some implementations, the graphical user interface may include a rail vehicle passenger comfort score field configured to display the determined rail vehicle passenger comfort score.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
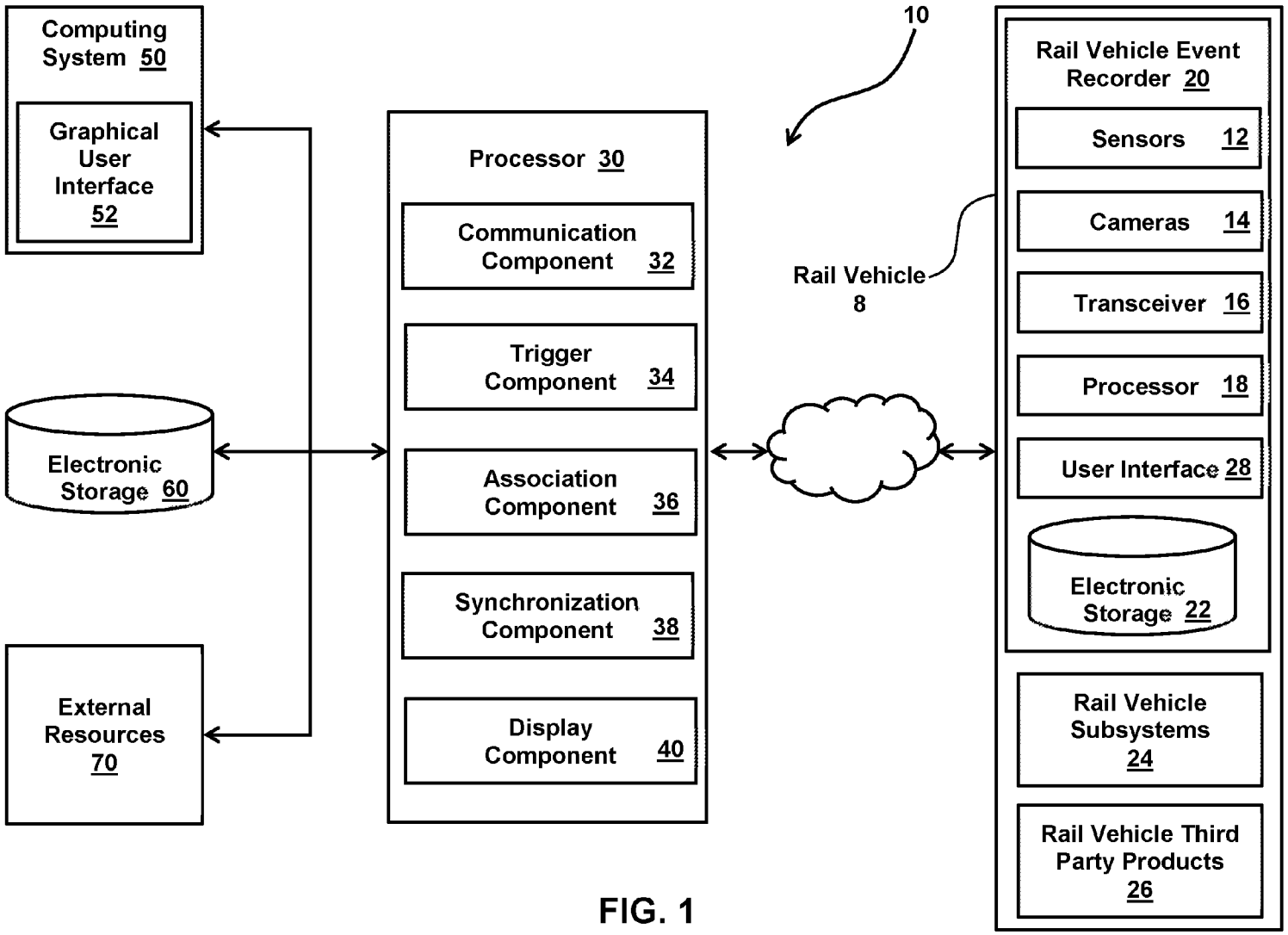
FIG. 1 illustrates a rail vehicle event analysis system configured to facilitate analysis of rail vehicle event records that correspond to rail vehicle events.

FIG. 1 illustrates a rail vehicle event analysis system 10 configured to facilitate analysis of rail vehicle event records that correspond to rail vehicle events. In some implementations, system 10 may include one or more of a physical computer processor 30, a computing system 50, electronic storage 60, external resources 70, and/or other components. System 10 may be configured to visually present a user with information related to operation of a rail vehicle 8. In some implementations, the user may review the information related to operation of rail vehicle 8 in real time, responsive to rail vehicle 8 being involved in a rail vehicle event, and/or at other times. System 10 may be configured to visually present information based on output signals generated by one or more sensors 12 associated with rail vehicle 8 and/or other sensors. System 10 may synchronize the presented information such that information from individual sensors 12 may be compared and/or viewed at the same time by the user. The information from individual sensors 12 may be compared and/or viewed at the same time by the user at one or more time points before, during, and/or after a vehicle event, and/or at other times. System 10 may be configured to receive observations made by the user based on the user's review of the presented visual information.

In some implementations, system 10 may include and/or receive information from a rail vehicle event recorder 20 coupled with rail vehicle 8. Rail vehicle event recorder 20 may include one or more of a sensor 12, a camera 14, a transceiver 16, a processor 18, electronic storage 22, a user interface 28, and/or other components. In some implementations, one or more of the components of rail vehicle event recorder 20 may be the same as and/or similar to one or more components of the rail vehicle event detection system described in U.S. patent application Ser. No. 14/525,416 filed Oct. 28, 2014 and entitled, "Rail Vehicle Event Detection and Recording System", which is incorporated herein by reference in its entirety.

Processor 30 of system 10 may be configured to provide information processing capabilities in system 10. As such, processor 30 may comprise one or more of a digital processor, an analog processor, a digital circuit designed to process information, an analog circuit designed to process information, a state machine, and/or other mechanisms for electronically processing information. Although processor 30 is shown in FIG. 1 as a single entity, this is for illustrative purposes only. In some implementations, processor 30 may comprise a plurality of processing units. These processing units may be physically located within the same device, or processor 30 may represent processing functionality of a plurality of devices operating in coordination (e.g., processor 18 of rail vehicle event recorder 20 operating in coordination with processor 30).

Processor 30 may be configured to execute one or more computer program components. The computer program components may comprise one or more of a communication component 32, a trigger component 34, an association component 36, a synchronization component 38, a display component 40, and/or other components. Processor 30 may be configured to execute components 32, 34, 36, 38, and/or 40 by software; hardware; firmware; some combination of software, hardware, and/or firmware; and/or other mechanisms for configuring processing capabilities on processor 30. It should be appreciated that although components 32, 34, 36, 38, and 40 are illustrated in FIG. 1 as being co-located within a single processing unit, in implementations in which processor 30 comprises multiple processing units, one or more of components 32, 34, 36, 38, and/or 40 may be located remotely from the other components (e.g., within processor 18 of rail vehicle event recorder 20). The description of the functionality provided by the different components 32, 34, 36, 38, and/or 40 described herein is for illustrative purposes, and is not intended to be limiting, as any of components 32, 34, 36, 38, and/or 40 may provide more or less functionality than is described. For example, one or more of components 32, 34, 36, 38, and/or 40 may be eliminated, and some or all of its functionality may be provided by other components 32, 34, 36, 38, and/or 40. As another example, processor 30 may be configured to execute one or more additional components that may perform some or all of the functionality attributed below to one of components 32, 34, 36, 38, and/or 40.

Communication component 32 may be configured to receive rail vehicle operation information and/or other information. The rail vehicle operation information may be received via output signals generated by sensors 12 and transceiver 16 coupled with a rail vehicle (described below). Communication component 32 may be configured to receive separate rail vehicle operation information from various individual sensors 12 e.g., from a first sensor that generates a first output signal conveying first operation information, a second sensor that generates a second output signal conveying second operation information, etc.) In some implementations, communication component 32 may be configured to receive rail vehicle location information that indicates a physical geographic location of rail vehicle 8 from one or more system location sensors 12 that are coupled with rail vehicle 8 and/or one or more non-system location sensors 12 that are not coupled with rail vehicle 8.

Trigger component 34 may be configured to detect rail vehicle events. Trigger component 34 may be configured to detect rail vehicle events based on the received rail vehicle operation information, parameters determined based on the received rail vehicle operation information, pre-determined rail vehicle event criteria sets (e.g., obtained from electronic storage 60, external resources 70, and/or other sources of information), and/or other information. The rail vehicle events may be detected, for example, by comparing the determined parameters to the criteria sets such that an individual vehicle event is detected responsive to the determined parameters satisfying a criteria set for the individual vehicle event. In some implementations, an individual rail vehicle event has a start time and an end time. In some implementations, an individual rail vehicle event may be related to one or more of a collision, a near collision, passing a red over red, passing a signal bar, a deadman, distracted operation of rail vehicle 8 by a rail vehicle operator, a penalty stop, slingshotting, excessive braking, an improper stop at a station, inappropriate language used by the rail vehicle operator, an intercom call, an intercom response, activation of an ATP bypass, a high horn, Positive Train Control PTC), Communications-Based Train Control (CBTC), and/or other rail vehicle events. In some implementations, trigger component 34 may be configured to detect rail vehicle events using methods similar to and/or the same as methods used by the rail vehicle event detection system described in U.S. patent application No. filed [DATE] and entitled, "Rail Vehicle Event Triggering System And Method", which is incorporated herein by reference in its entirety.

Association component 36 may be configured to associate information from two or more of the output signals generated during an individual rail vehicle event to create a corresponding rail vehicle event record. Association component 36 may be configured to associate the information responsive to trigger component 34 detecting a vehicle event, and/or responsive to other events. In some implementations, associating information in the individual output signals may include associating information with a corresponding time location in an event timeline based on time information included in the output signals. In some implementations, this may not produce a synchronized event timeline. For example, the timing information in a first output signal (e.g., information indicating the start of an event at 2:40:48 PM) may not coincide with the timing information in a second output signal (e.g., information indicating the start of the same event may be received at 2:41:02 PM) even though both output signals include information related to the same event. In such implementations, synchronization component 38 (described below) may analyze information in the individual output signals and associate corresponding information in the individual output signals with the same time location in an event timeline, regardless of any time information in the output signals.

Synchronization component 38 may be configured to synchronize the operation information from output signals generated during a given rail vehicle event. Synchronization component 38 may be configured to synchronize the operation information based on analysis of the information conveyed by the output signals, and/or other information. Synchronization component 38 may be configured to synchronize the operation information such that, for example, first operation information from a first output signal during a first rail vehicle event and second operation information from a second output signal during the first rail vehicle event is synchronized. The rail vehicle operation information in the various output signals received by communication component 32 may be delayed relative to one or more other output signals. These delays may vary by the signal (e.g., rail vehicle speed information may be received "faster" than location information). These delays may be related to how the underlying sensors collect data, for example.

The operation information may be synchronized by identifying and/or correlating corresponding phenomena in the first output signal and the second output signal during the first rail vehicle event and/or by other methods. In some implementations, synchronization component 38 may be configured such that the analysis of the information conveyed by the output signals includes searching for expected phenomena in the second output signal (for example) that corresponds to timing information conveyed by the first output signal and/or searching for other corresponding information. The timing information may indicate, for example, one or more of a time of day the information was generated, an order in which the information was generated, and/or other timing information.

In some implementations, synchronization component 38 may be configured such that the analysis and/or synchronization of the information conveyed by the output signals includes determining information based on the output signals and then synchronizing the determined information with other information in a vehicle event record. In some implementations, synchronization component 38 may be configured such that the analysis of the information conveyed by the output signals includes determining information based on visual images generated by one or more system (e.g., cameras 14) and/or non-system cameras and/or other visual information capturing devices (e.g., included in external resources 70). For example, in some implementations, synchronization component 38 may be configured such that the analysis of the information conveyed by the output signals includes detecting presence of pedestrians near the exterior of rail vehicle 8, and/or other information (e.g., location information may be obtained based on a street name and/or street address visible in video images) based on acquired visual information (e.g., acquired via sensors 12 and/or cameras 14 described below and/or other devices).

As another example, in some implementations, synchronization component 38 may be configured such that the analysis of the information conveyed by the output signals includes a determination of a rail vehicle passenger comfort score, a vehicle event severity score, and/or other metrics. These scores and/or metrics may be determined based on information in one or more output signals received by communication component 32, visual information obtained by one or more system and/or non-system visual information acquisition devices, and/or other information.

In some implementations, synchronization component 38 may be configured to synchronize rail vehicle location information with the information from the output signals generated during a given rail vehicle event, information determined by synchronization component 38 as described above, and/or other information in a given rail vehicle event record. The rail vehicle location information may indicate a physical geographic location of rail vehicle 8 from one or more system location sensors (e.g., sensors 12) that are coupled with rail vehicle 8 and/or one or more non-system location sensors that are not coupled with rail vehicle 8. For example, the one or more system location sensors may include aftermarket sensors 12 (e.g., GPS sensors) coupled with rail vehicle 8, rail vehicle 8 subsystem sensors 12 installed in rail vehicle 8 at manufacture, and/or other system location sensors. The one or more non-system location sensors (e.g., sensors included in external resources 70) may include track sensors coupled with a track rail vehicle 8 rides on, signaling devices and/or other components used to control rail traffic within a rail system (e.g., a network of tracks and/or rail vehicles), cameras and/or other visual information gathering devices positioned along the trail rail vehicle 8 rides on, and/or other non-system sensors.

Display component 40 may be configured to facilitate presentation of the synchronized rail vehicle operation information and/or other information to a user. In some implementations, the user may be a reviewer and/or other users. In some implementations, a reviewer may be a non-rail vehicle operator user and/or other users. In some implementations, the reviewer may be located remotely from rail vehicle 8, from processor 30, and/or other components of system 10. In some implementations display component 40 may be configured such the reviewer may review the synchronized rail vehicle operation information via a graphical user interface 52 of computing system 50, and/or other devices. In some implementations, display component 40 may be configured to cause graphical user interface 52 to present the synchronized rail vehicle operation information to a reviewer and/or other users in real-time or near real-time during operation of rail vehicle 8.

Facilitating presentation of the synchronized rail vehicle operation information and/or other information to a reviewer and/or other users may include effectuating presentation of graphical user interface 52 via computing system 50, for example. In some implementations, graphical user interface 52 may be configured to facilitate entry and/or selection of information from a reviewer, display information to the reviewer, and/or function in other ways. Display component 40 may be configured to facilitate presentation of one or more views of graphical user interface 52 to a reviewer and/or other users. The views of graphical user interface 52 may include one or more fields that correspond to the one or more sensors, a timeline field, and/or other fields. In some implementations, information presented in the one or more fields that correspond to the one or more sensors may be synchronized to a common timeline displayed in the timeline field. In some implementations, graphical user interface 52 may include a rail vehicle passenger comfort score field configured to display the determined rail vehicle passenger comfort score (e.g., as described above).

Figure 2A:
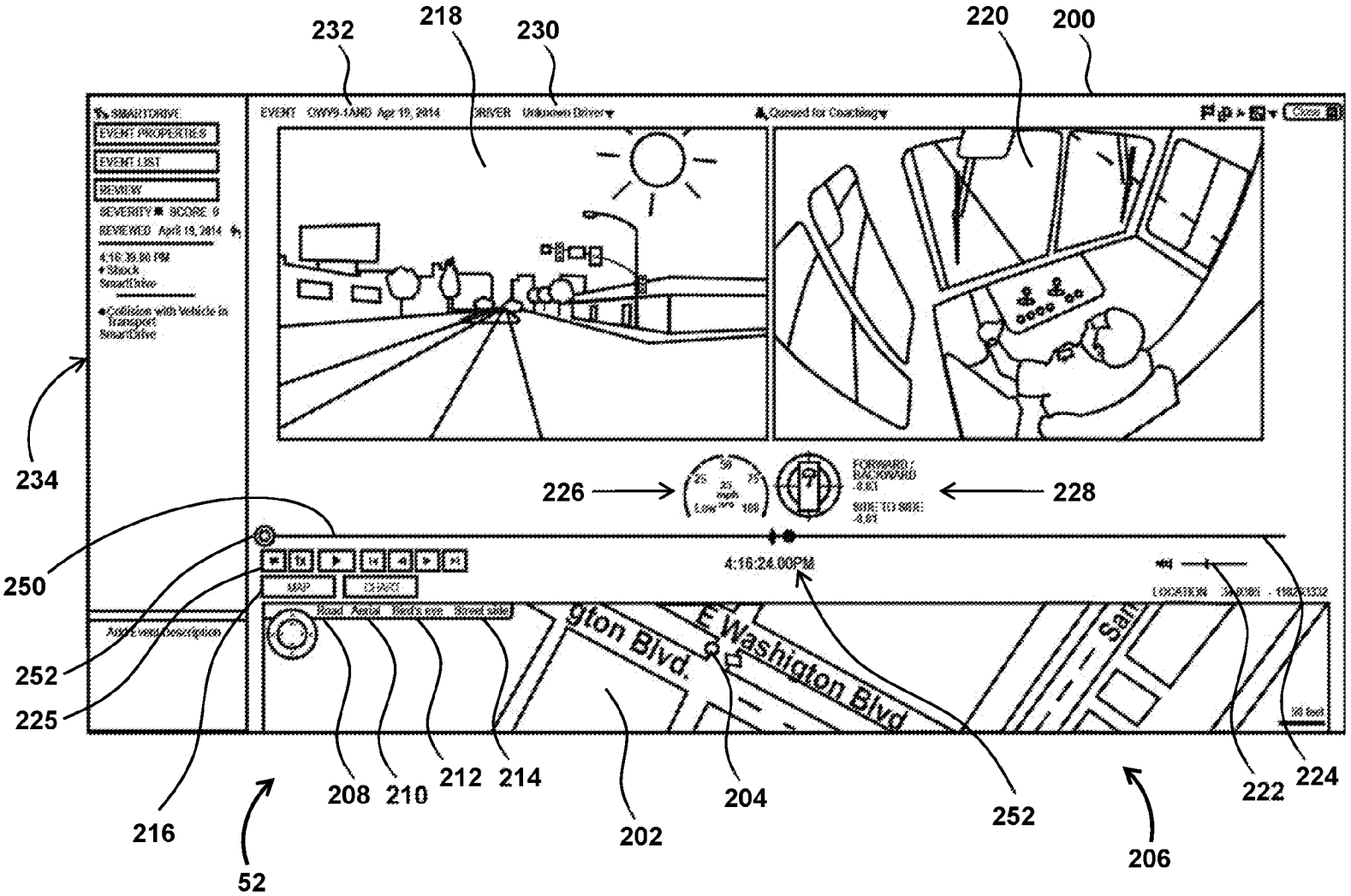
FIG. 2A illustrates a view of a graphical user interface presented to a user via a computing system.

For example, FIG. 2A illustrates a view 200 of graphical user interface 52 presented to the user via computing system 50 (FIG. 1). As shown in FIG. 2A, in some implementations, view 200 of graphical user interface 52 may include a geographic map field 202, one or more video information fields 218, 220, a volume field 222 to facilitate control over a volume of audio information played back to the user, a timeline field 224, video playback control fields 225, sensor related fields 226, 228, a vehicle operator identification field 230, an event name field 232, one or more observation fields 234, and/or other fields.

Geographic map field 202 may be configured to display a geographic location 204 of rail vehicle 8 (FIG. 1) during a given rail vehicle event on a map 206. Geographic map field 202 may be changed between one or more of a road view (shown in FIG. 2A), an aerial view, a bird's eye view, a street side view, and/or other views via control tabs 208, 210, 212, and/or 214. In some implementations, geographic map field 202 may be configured to include a spatial highlight (e.g., highlighting portions of Washington Blvd. in the image) superimposed on the map image to mark regions where rail vehicle 8 has travelled and/or to indicate other information. In some implementations, geographic map field 202 may be changed to a chart illustrating information related to one or more output signals received via communication component 32 (FIG. 1) over time (e.g., as shown in FIG. 2B described below) via control 216.

In FIG. 2A, video information field 218 illustrates a field of view from a camera directed ahead of rail vehicle 8. Video information field 220 illustrates a field of view from a camera positioned in an operator compartment of rail vehicle 8. Sensor related field 226 presents a representation of the speed of rail vehicle 8. Sensor related field 228 presents a representation of the acceleration of rail vehicle 8. Other sensor related fields that may be included in view 200 may include fields that convey information related to safety systems of rail vehicle 8, fields that convey information related to mechanical systems of rail vehicle 8, fields that convey information related to communication systems of rail vehicle 8, fields that convey information related to passengers riding in rail vehicle 8, fields that convey information related to an operator of rail vehicle 8 (e.g., in addition to field 220), fields that convey information related to movement of rail vehicle 8, fields that convey information related to an orientation of rail vehicle 8, fields that convey information related to a geographic position of rail vehicle 8 e.g., in addition to map field 202), fields that convey information related to a track rail vehicle 8 rides on, fields that convey information related to a spatial position of rail vehicle 8 relative to other objects, and/or other fields that convey other information. Observation fields 234 may be used by a reviewer and/or other users to enter and/or select observation information related to the vehicle event (e.g., as described herein).

The information in the various fields of view 200 may be synchronized to timeline 250 shown in timeline field 224. Timeline 250 may include one or more timeline indicators 252 that indicate where along timeline 250 the information in the various fields occurs, a current playback instant along the timeline, and/or other information. In some implementations, a user may control the length of timeline 250, select (e.g., by clicking and/or touching a location) an individual time instant along timeline 250, continuously play frame instants in video playback fields 218, 220, rewind and/or fast forward frame instants in video playback fields 218, 220, and/or control timeline 250 in other ways.

Figure 2B:
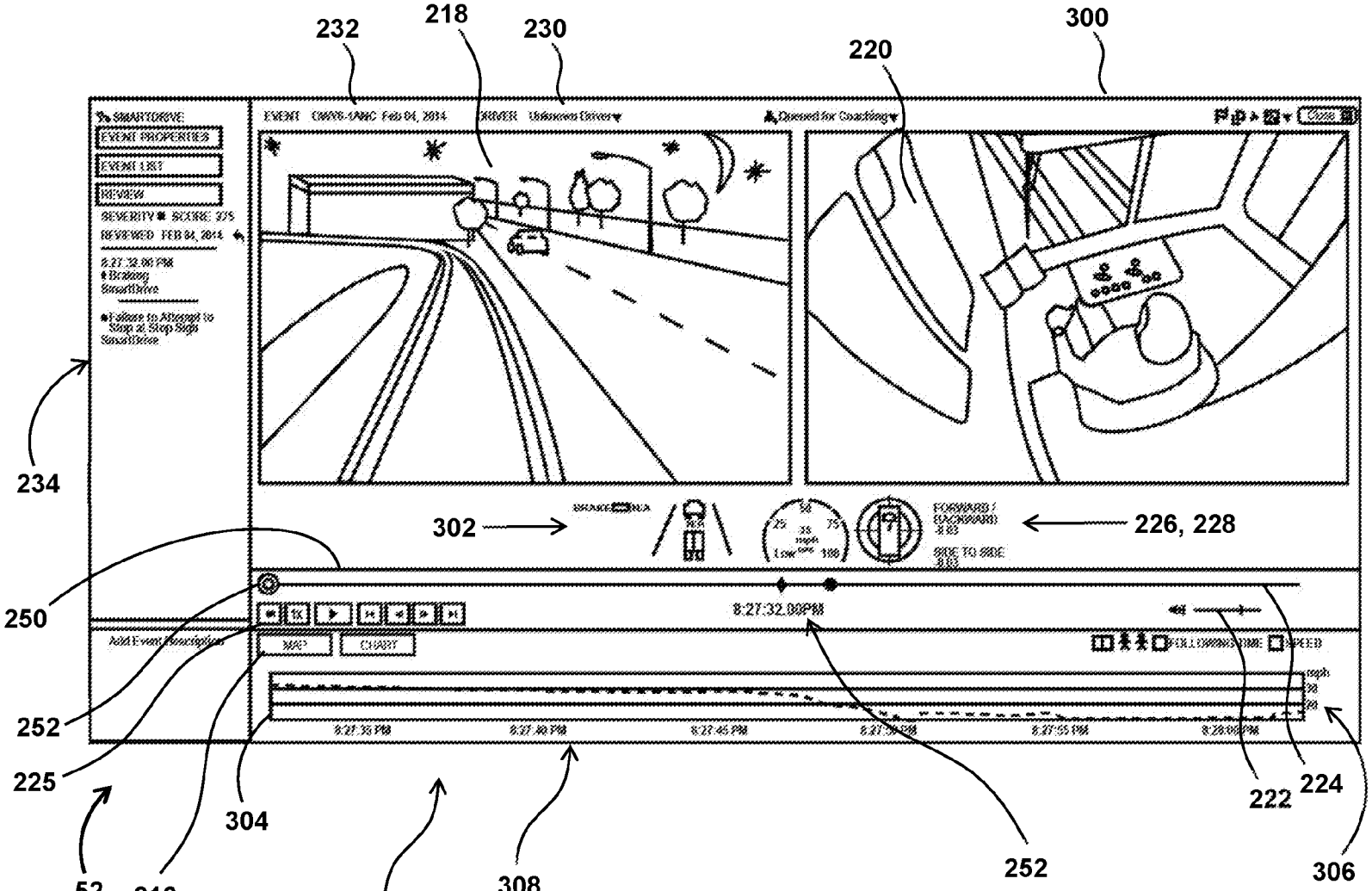
FIG. 2B illustrates a second view of the graphical user interface presented to the user via the computing system.

FIG. 2B illustrates a second view 300 of graphical user interface 52 presented to the user. FIG. 2B illustrates operation of rail vehicle 8 (FIG. 1) at night. FIG. 2B illustrates video information fields 218, 220, volume field 222, timeline field 224, video playback control fields 225, sensor related fields 226, 228, vehicle operator identification field 230, event name field 232, one or more observation fields 234, and/or other fields. View 300 includes a sensor related field 302 that illustrates whether a non-rail vehicle has encroached into space occupied by and/or that will be occupied by rail vehicle 8. View 300 also includes a chart 320 illustrating following time between rail vehicle 8 and a vehicle in front of rail vehicle 8 and/or rail vehicle speed 306 over time 308. In some implementations, chart 320 may include an indicator (not shown) that indicates a location along chart 320 that corresponds to a current time instant along timeline 250. Chart 320 may be activated via control 216, for example.

Figure 2C:
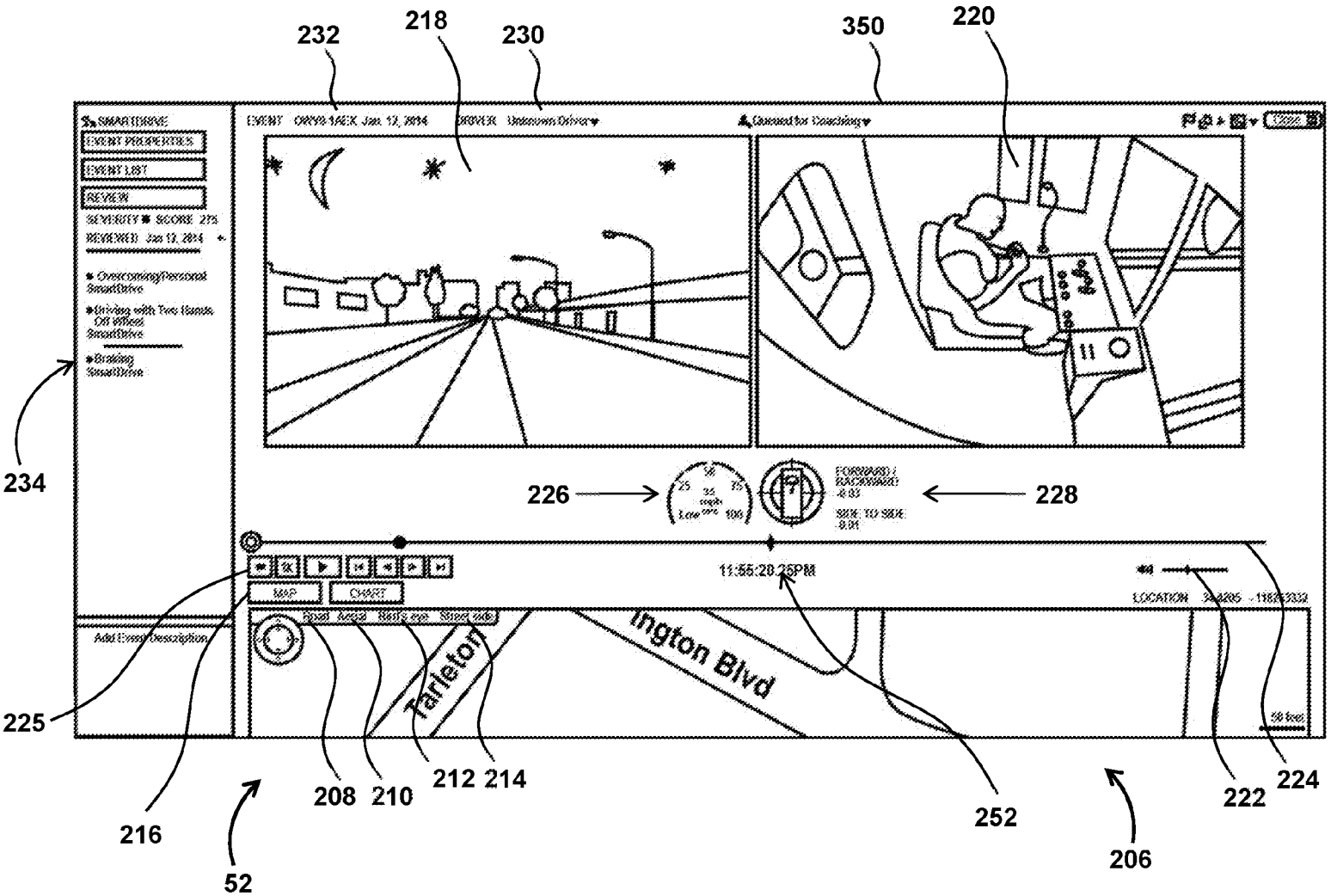
FIG. 2C illustrates a third view of the graphical user interface presented to the user via the computing system.

FIG. 2C illustrates a third view 350 of graphical user interface 52 presented to the user. FIG. 2C illustrates geographic map field 202, video information fields 218, 220, volume field 222, timeline field 224, video playback control fields 225, sensor related fields 226, 228, vehicle operator identification field 230, event name field 232, one or more observation fields 234, and/or other fields. In FIG. 2C, video information field 220 illustrates a distracted vehicle operator with both hands off of the controls of the rail vehicle using his knee to hold a master control lever. The other fields (e.g., 202, 218, 224, 226, 228, etc.) in view 350 illustrate corresponding synchronized information related to the rail vehicle while the rail vehicle operator's hands are off the controls.

The examples of the views and the fields of graphical user interface 52 shown in FIG. 2A-2C are not intended to be limiting. The system described herein may have any number of fields of any type included in graphical user interface 52 (e.g., more and/or less views and/or fields may be included and/or eliminated relative to the views and/or fields shown in FIG. 2A-2C). The various fields in a given view may be positioned anywhere in the view of graphical user interface that 52 is helpful to the user. For example, additional fields that correspond to additional cameras and/or sensors may be provided; the fields may be arranged within a view by the user, etc. The additional fields and/or adjusted arrangement may give greater perspective regarding a vehicle event to a reviewer and/or other user's reviewing the information, for example.

Returning to FIG. 1, in some implementations, graphical user interface 52 may include one or more views (e.g., such as the views described above) configured to facilitate entry and/or selection of observations related to vehicle events from the reviewer and/or other users. In some implementations, the observations may include and/or otherwise be related to coaching feedback directed to an operator of rail vehicle 8, and/or other information. The reviewer and/or other users may make observations based on the synchronized rail vehicle operation information presented to the reviewer/user and/or other information. In some implementations, the observations may include observations related to a collision, a near collision, passing a red over red, passing a signal bar, a deadman, distracted operation of rail vehicle 8 by a rail vehicle operator, a penalty stop, slingshotting, excessive braking, an improper stop at a station, inappropriate language used by the rail vehicle operator, an intercom call, an intercom response, activation of an ATP bypass, a high horn, Positive Train Control (PTC), Communications-Based Train Control (CBTC), and or other rail vehicle events. In some implementations, association component 36 and/or synchronization component 38 may be configured to associate the observations with a corresponding rail vehicle event record and/or synchronize the observations with the rest of the vehicle operation information in a rail vehicle event record.

In some implementations, trigger component 34, association component 36, and/or synchronization component 38 may be configured to filter detected vehicle events, the observations, and/or other information based on geo-fences and/or other filtering criteria. Geo-fences may be virtual boundaries that define physical areas where one or more rail vehicle events are permissible or are not permissible, for example. For example, geo-fences may bound a rail yard, a specific intersection crossed by rail vehicle 8, a specific track ridden by rail vehicle 8, and/or other geo-fences. In some implementations, trigger component 34, association component 36, and/or synchronization component 38 may be configured to alert one or more users when a vehicle event has occurred and/or an observation has been made in a geographical area where a corresponding vehicle event and/or specific observed actions are not permissible.

Computing system 50 may include one or more processors, a user interface (e.g., including a display configured to display graphical user interface 52), electronic storage, and/or other components. Computing system 50 may be configured to enable a user e.g., a reviewer and/or other users) to interface with system 10 (e.g., as described above), and/or provide other functionality attributed herein to computing system 50. Computing system 50 may be configured to communicate with processor 30, rail vehicle event recorder 20, external resources 70, and/or other devices via a network such as the internet, cellular network, Wi-Fi network, Ethernet, and other interconnected computer networks. In some implementations, computing system 50 may be configured to communicate with processor 30, rail vehicle event recorder 20, external resources 70, and/or other devices via wires. In some implementations, computing system 50 may include processor 30, and/or other components of system 10. Computing system 50 may facilitate viewing and/or analysis of the information conveyed by the output signals of sensors 12, the information determined by processor 30, the information stored by electronic storage 60, information provided by external resources 70, and/or other information. By way of non-limiting example, computing system 50 may include one or more of a server, a server cluster, desktop computer, a laptop computer, a handheld computer, a tablet computing platform, a NetBook, a Smartphone, a gaming console, and/or other computing platforms.

Figure 3:
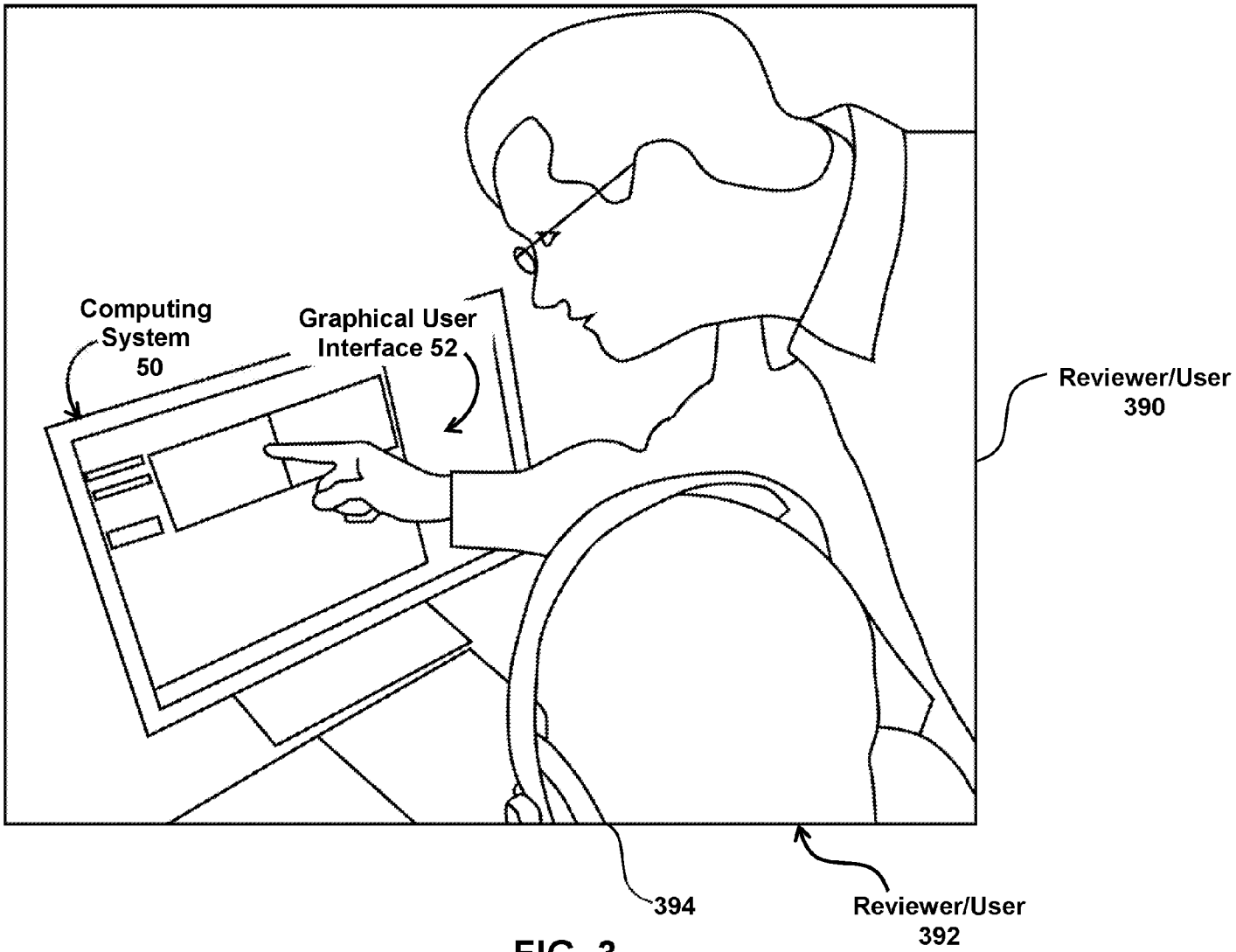
FIG. 3 illustrates a reviewer reviewing a vehicle event record via a graphical user interface displayed on a computing system.

By way of a non-limiting example, FIG. 3 illustrates reviewers 390, 392 reviewing a vehicle event record via graphical user interface 52 displayed on computing system 50. As shown in FIG. 3, in some implementations, graphical user interface 52 may be configured to facilitate entry and/or selection of information (e.g., observations) from reviewers 390, 392, display information to reviewers 390, 392, and/or function in other ways. In this example, computing system 50 includes headphones 394 that allow reviewer 392 to listen to audio information in a vehicle event record that has been synchronized to a vehicle event timeline (e.g., as described above).

Returning to FIG. 1, electronic storage 60 may be configured to store electronic information. Electronic storage 60 may comprise electronic storage media that electronically stores information. The electronic storage media of electronic storage 60 may comprise one or both of system storage that is provided integrally (i.e., substantially non-removable) with system 10 and/or removable storage that is removably connectable to system 10 via, for example, a port (e.g., a USB port, a firewire port, etc.) or a drive (e.g., a disk drive, etc.). Electronic storage 60 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 60 may store software algorithms, recorded video event data, information determined by processor 30, information received via user interface 20, computing system 50, external resources 70, and/or other devices, and/or other information that enables system 10 to function properly. Electronic storage 60 may be (in whole or in part) a separate component within system 10, or electronic storage 60 may be provided (in whole or in part) integrally with one or more other components of system 10 (e.g., computing system 50, processor 30, etc.).

External resources 70 may include sources of information (e.g., an electronic vehicle event criteria database, a vehicle event records database), one or more servers that are part of system 10, one or more servers outside of system 10 (e.g., one or more servers associated with a rail vehicle client network), a network (e.g., the internet), electronic storage, equipment related to wireless communication technology, communication devices, and/or other resources. In some implementations, some or all of the functionality attributed herein to external resources 70 may be provided by resources included in system 10. External resources 70 may be configured to communicate with processor 30, computing system 50, and/or other components of system 10 via wired and/or wireless connections, via a network (e.g., a local area network and/or the internet), via cellular technology, via WiFi technology, and/or via other resources.

Figure 4:
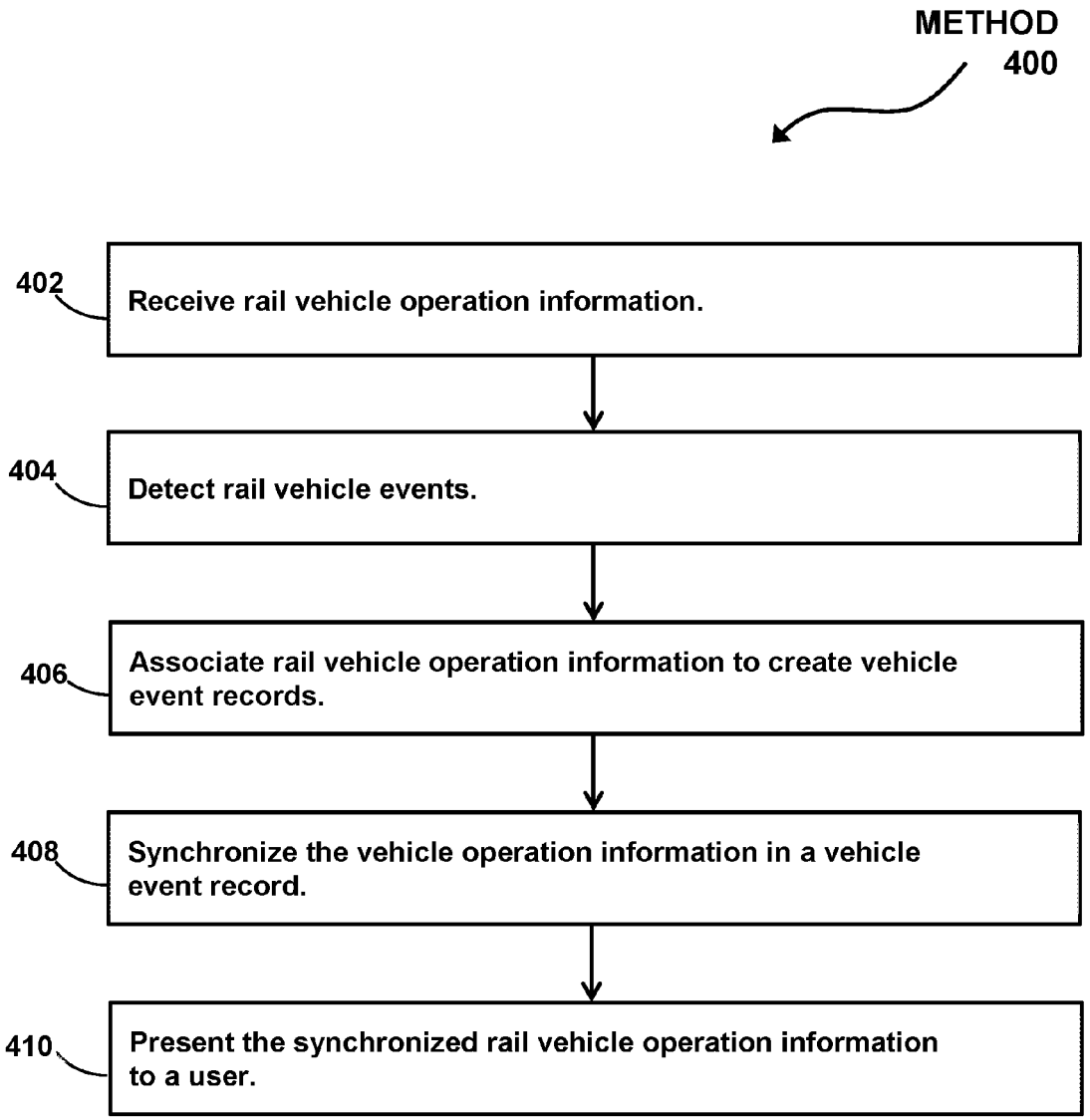
FIG. 4 illustrates a method for facilitating analysis of rail vehicle event records that correspond to rail vehicle events.

FIG. 4 illustrates a method 400 for facilitating analysis of rail vehicle event records that correspond to rail vehicle events. The method includes synchronizing rail vehicle operation information. The operations of method 400 presented below are intended to be illustrative. In some implementations, method 400 may be accomplished with one or more additional operations not described, and/or without one or more of the operations discussed. Additionally, the order in which the operations of method 400 are illustrated in FIG. 4 and described below is not intended to be limiting. In some implementations, for example, two or more of the operations may occur substantially simultaneously.

In some implementations, method 400 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 400 in response to instructions stored electronically on one or more electronic storage mediums. The one or more processing devices may include one or more devices configured through hardware, firmware, and/or software to be specifically designed for execution of one or more of the operations of method 400.

At an operation 402, rail vehicle operation information may be received. Rail vehicle operation information may be received via output signals generated by sensors coupled with a rail vehicle and/or other sources of information. The sensors may include, for example, a first sensor that generates a first output signal conveying first operation information, and a second sensor that generates a second output signal conveying second operation information. Examples of the one or more sensors may include a video camera, a rail vehicle safety system sensor, a rail vehicle mechanical system sensor, a rail vehicle electrical system sensor, an accelerometer, a gyroscope, a geolocation sensor, a radar detector, and/or other sensors.

In some implementations, receiving rail vehicle operation information may include receiving acquired visual information that represents an environment about the rail vehicle. The environment about the rail vehicle may include areas in or near an interior and an exterior of the rail vehicle. In some implementations, operation 402 may include receiving rail vehicle location information that indicates a physical geographic location of the rail vehicle from one or more system location sensors that are coupled with the rail vehicle and/or one or more non-system location sensors that are not coupled with the rail vehicle. In some implementations, operation 402 may be performed by a processor component the same as or similar to communication component 32 (shown in FIG. 1 and described herein).

At an operation 404, rail vehicle events may be detected. The rail vehicle events may be detected based on the received rail vehicle operation information, parameters determined based on the received rail vehicle operation information, pre-determined rail vehicle event criteria sets, and/or other information. The rail vehicle events may be detected, for example, by comparing the determined parameters to the criteria sets such that an individual vehicle event is detected responsive to the determined parameters satisfying a criteria set for the individual vehicle event. In some implementations, an individual rail vehicle event has a start time and an end time. In some implementations, an individual rail vehicle event may be related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, activation of an ATP bypass, and or other rail vehicle events. In some implementations, operation 404 may be performed by a processor component the same as or similar to trigger component 34 (shown in FIG. 1 and described herein).

At an operation 406, rail vehicle operation information from different sensors may be associated to create vehicle event records. In some implementations, information from two or more of the output signals generated during an individual vehicle event may be associated to create a vehicle event record. In some implementations, operation 406 may be performed by a processor component the same as or similar to association component 36 (shown in FIG. 1 and described herein).

At an operation 408, the rail vehicle operation information in a vehicle event record may be synchronized. The information from the two or more output signals generated during a rail vehicle event may be synchronized based on analysis of the information conveyed by the output signals such that, for example, first operation information from the first output signal during a first rail vehicle event and second operation information from the second output signal during the first rail vehicle event is synchronized by identifying and correlating corresponding phenomena in the first output signal and the second output signal during the first rail vehicle event.

The analysis of the information conveyed by the output signals may include searching for expected phenomena in the second output signal that corresponds to timing information conveyed by the first output signal. The timing information may indicate a time of day the information was generated, an order in which the information was generated, and/or other information. In some implementations, the analysis of the information conveyed by the output signals may include a determination of a rail vehicle passenger comfort score, and/or other determinations. In some implementations, the analysis of the information conveyed by the output signals may include detecting presence of pedestrians near the exterior of the rail vehicle based on the acquired visual information. In some implementations, synchronizing may include synchronizing the rail vehicle location information with the information from the two or more output signals generated during the first rail vehicle event. In some implementations, operation 408 may be performed by a processor component the same as or similar to synchronization component 38 (shown in FIG. 1 and described herein).

At an operation 410, the synchronized rail vehicle operation information may be presented to a user. The synchronized rail vehicle operation information may be presented to a user with a graphical user interface and/or other devices. In some implementations, a view of the graphical user interface may include one or more fields that correspond to the one or more sensors, a timeline field, and/or other fields. Information presented in the one or more fields may be synchronized to a common timeline that is displayed in the timeline field. In some implementations, the graphical user interface may include a geographic map field configured to display a geographic location of the rail vehicle during the first rail vehicle event (for example) on a map.

In some implementations, one or more fields of the graphical user interface may be configured to receive entry and/or selection of one or more observations made by the user based on the synchronized rail vehicle operation information presented to the user. The observations may be associated with a vehicle event record. In some implementations, the observations may be filtered based on geo-fences. Geo-fences may be virtual boundaries that define physical areas where one or more rail vehicle events are permissible or are not permissible. In some implementations, the graphical user interface may be configured to present the synchronized rail vehicle operation information to a non-rail vehicle operator user in real-time or near real-time during operation of the rail vehicle. In some implementations, the graphical user interface may include a rail vehicle passenger comfort score field configured to display the determined rail vehicle passenger comfort score. In some implementations, operation 410 may be performed by a processor component the same as or similar to display component 40 shown in FIG. 1 and described herein).

Returning to FIG. 1 and rail vehicle event recorder 20, in some implementations, rail vehicle event recorder 20 may be coupled to and/or otherwise in communication with rail vehicle subsystems 24, rail vehicle third party products 26, and/or other components of rail vehicle 8. Rail vehicle subsystems 24 may include mechanical subsystems, vehicle safety subsystems, track safety subsystems, inter-railcars safety subsystems, camera subsystems, DVR subsystems, and/or other rail vehicle subsystems. Rail vehicle event recorder 20 may be configured to be coupled with the rail vehicle subsystems so that information may be transmitted wirelessly and/or rail vehicle event recorder 20 may be physically coupled with the rail vehicle subsystems via wires and/or other physical couplings. Rail vehicle third party products 26 may include DVR systems, safety systems, and/or other rail vehicle third party products. In some implementations, rail vehicle event recorder 20 may be configured to communicate with rail vehicle third party products wireless and/or via wires. For example, rail vehicle event recorder 20 may be physically coupled with a rail third party DVR system. As another example, rail vehicle event recorder 20 may be configured to communicate with a CBTC safety system via a physical coupling.

Sensors 12 may be configured to generate output signals conveying information related to the operation and/or context of rail vehicle 8, and/or other information. In some implementations, the output signals may convey information related to safety systems of rail vehicle 8, mechanical systems of rail vehicle 8, communication systems of rail vehicle 8, passengers riding in rail vehicle 8, an operator of rail vehicle 8, movement of rail vehicle 8, an orientation of rail vehicle 8, a geographic position of rail vehicle 8, a track rail vehicle 8 rides on, a spatial position of rail vehicle 8 relative to other objects, and/or other information. Such output signals may be generated by one or more rail vehicle subsystem sensors (e.g., included in a vehicle on-board data system), one or more third party aftermarket sensors, and/or other sensors 12. Sensor 12 may include one or more sensors located adjacent to and/or in communication with the various mechanical systems of rail vehicle 8, adjacent to and/or in communication with the various safety systems of rail vehicle 8, in one or more positions (e.g., at or near the front/rear of rail vehicle 8) to accurately acquire information representing the vehicle environment (e.g. visual information, spatial information, orientation information), in one or more locations to monitor biological activity of the rail vehicle operator (e.g., worn by the rail vehicle operator), and/or in other locations. In some implementation, sensors 12 may include one or more of a video camera (e.g., one or more cameras 14), a rail vehicle safety system sensor, a rail vehicle mechanical system sensor, a rail vehicle electrical system sensor, an accelerometer, a gyroscope, a geolocation sensor, a radar detector, and/or other sensors.

Cameras 14 may be configured to acquire visual information representing a rail vehicle environment. Any number of individual cameras 14 may be positioned at various locations on and/or within rail vehicle 8. The rail vehicle environment may include spaces in and around an interior and/or an exterior of rail vehicle 8. Cameras 14 may be configured such that the visual information includes views of exterior sides of rail vehicle 8, interior compartments of rail vehicle 8, and/or other areas to capture visual images of activities that occur at or near the sides of rail vehicle 8, in front of and/or behind rail vehicle 8, within rail vehicle 8, on streets surrounding rail vehicle tracks, and/or in other areas. In some implementations, one or more cameras 14 may be rail vehicle system cameras previously installed in rail vehicle 8. In some implementations, one or more cameras 14 may be a third party aftermarket camera coupled with rail vehicle 8. In some implementations, visual information may be received from a third party camera and/or digital video recorder (DVR) system.

Transceiver 16 may comprise wireless communication components configured to transmit and receive electronic information. In some implementations, processor 30 may receive wireless communication of rail vehicle event information (e.g., output signals from sensors 12) via transceiver 16 and/or other wireless communication components. Transceiver 16 may be configured to transmit and/or receive encoded communication signals. Transceiver 16 may include a base station and/or other components. In some implementations, transceiver 16 may be configured to transmit and receive signals via one or more radio channels of a radio link; via one or more wireless networks such as a Wi-Fi network, the internet, a cellular network, and/or other wireless networks; and/or other communication networks. In some implementations, transceiver 16 may be configured to transmit and receive communication signals substantially simultaneously.

Processor 18 may be configured to provide information processing capabilities in rail vehicle event recorder 20. As such, processor 18 may comprise one or more of a digital processor, an analog processor, a digital circuit designed to process information, an analog circuit designed to process information, a state machine, and/or other mechanisms for electronically processing information. Although processor 18 is shown in FIG. 1 as a single entity, this is for illustrative purposes only. In some implementations, processor 18 may comprise a plurality of processing units. These processing units may be physically located within the same device, or processor 18 may represent processing functionality of a plurality of devices operating in coordination.

Electronic storage 22 may be configured to store electronic information. Electronic storage 22 may comprise electronic storage media that electronically stores information. The electronic storage media of electronic storage 22 may comprise one or both of system storage that is provided integrally (i.e., substantially non-removable) with rail vehicle event recorder 20 and/or removable storage that is removably connectable to rail vehicle event recorder 20 via, for example, a port (e.g., a USB port, a firewire port, etc.) or a drive (e.g., a disk drive, etc.). Electronic storage 22 may comprise one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 22 may store software algorithms, recorded video event data, information determined by processor 18 (and/or processor 30), information received via user interface 28, and/or other information that enables rail vehicle event recorder 20 and/or system 10 to function properly. Electronic storage 22 may be (in whole or in part) a separate component within rail vehicle event recorder 20 and/or system 10, or electronic storage 22 may be provided (in whole or in part) integrally with one or more other components of rail vehicle event recorder 20 (e.g., user interface 28, processor 18, etc.).

User interface 28 may be configured to provide an interface between rail vehicle event recorder 20, and/or system 10 overall, and users, through which the users may provide information to and receive information from rail vehicle event recorder 20 and/or system 10. This enables predetermined profiles, criteria, data, cues, results, instructions, and/or any other communicable items, collectively referred to as "information," to be communicated between a user and one or more of processor 18, sensors 12, cameras 14, electronic storage 22, rail vehicle subsystems 24, rail vehicle third party products 26, and/or other components of rail vehicle event recorder 20 and/or system 10. In some implementations, all and/or part of user interface 28 may be included in a housing that houses one or more other components of rail vehicle event recorder 20, in computing system 50, and/or in other locations. Examples of interface devices suitable for inclusion in user interface 28 comprise a keypad, buttons, switches, a keyboard, knobs, levers, a display screen, a touch screen, speakers, a microphone, an indicator light, an audible alarm, a printer, a tactile feedback device, and/or other interface devices. In one implementation, user interface 28 comprises a plurality of separate interfaces (e.g., one interface in the driver compartment of rail vehicle 8 and one interface included in computing system 50). In some implementations, user interface 28 comprises at least one interface that is provided integrally with processor 18 and/or electronic storage 22. It is to be understood that other communication techniques, either hard-wired or wireless, are also contemplated by the present disclosure as user interface 28. In some implementations, user interface 28 may be included in a removable storage interface provided by electronic storage 22. In this example, information may be loaded into rail vehicle event recorder 20 wirelessly from a remote location (e.g., via a network), from removable storage (e.g., a smart card, a flash drive, a removable disk, etc.), and/or other sources that enable the user(s) to customize the implementation of rail vehicle event recorder 20. Other exemplary input devices and techniques adapted for use with rail vehicle event recorder 20 as user interface 28 comprise, but are not limited to, an RS-232 port, RF link, an IR link, modem (telephone, cable, and/or other modems), a cellular network, a Wi-Fi network, a local area network, and/or other devices and/or systems. In short, any technique for communicating information with rail vehicle event recorder 20 is contemplated by the present disclosure as user interface 28.

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A rail vehicle event analysis system comprising one or more physical computer processors configured by computer readable instructions to:

receive rail vehicle operation information via output signals generated by sensors coupled with a rail vehicle, the sensors including a first sensor that generates a first output signal conveying first operation information, and a second sensor that generates a second output signal conveying second operation information, wherein the first output signal is associated with first timing information, and wherein the second output signal is associated with second timing information;

obtain rail vehicle event information defining a first rail vehicle event, the first rail vehicle event having a start time and an end time;

detect the start time of the first rail vehicle event in the first operation information, wherein the first timing information includes a first time-stamp that indicates the start time of the first rail vehicle event in the first operation information;

detect the start time of the first rail vehicle event in the second operation information, wherein the second timing information includes a second time-stamp that indicates the start time of the first rail vehicle event in the second operation information, and wherein the first time-stamp does not coincide with the second time-stamp; and synchronize the first operation information and the second operation information based on analysis of the first time-stamp and the second time-stamp, wherein synchronizing includes identifying and correlating corresponding phenomena in the first output signal and the second output signal during the first rail vehicle event.

2. The system of claim 1, wherein the output signals generated by the sensors convey information regarding movement of the rail vehicle or actions performed by a vehicle operator of the rail vehicle.

3. The system of claim 1, wherein the one or more physical computer processors are further configured to associate the first operation information and the second operation information to create a first rail vehicle event record.

4. The system of claim 3, wherein the one or more physical computer processors are further configured to store the first rail vehicle event record in electronic storage.

5. The system of claim 3, wherein the one or more physical computer processors are further configured to present the first rail vehicle event record, via a graphical user interface, to a user.

6. The system of claim 1, wherein the one or more physical computer processors are configured such that synchronizing includes searching for expected phenomena in the second output signal that indicate the start time of the first rail vehicle event, wherein the first timing information indicating one or more of a time of day the information was generated, or an order in which the information was generated.

7. The system of claim 1, wherein the one or more processors are configured such that the first rail vehicle event is related to one or more of a collision, a near collision, passing a red over red, passing a signal bar, a deadman, distracted operation of the rail vehicle by a rail vehicle operator, a penalty stop, slingshotting, excessive braking, an improper stop at a station, inappropriate language used by the rail vehicle operator, an intercom call, an intercom response, or activation of an ATP bypass.

8. The system of claim 1, wherein both the first sensor and the second sensor are a rail vehicle safety system sensor, a rail vehicle mechanical system sensor, a rail vehicle electrical system sensor, an accelerometer, a gyroscope, a geolocation sensor, or a radar detector.

9. The system of claim 1, further comprising a graphical user interface configured to present the synchronized first and second operation information to a user, wherein a view of the graphical user interface includes one or more fields that correspond to the one or more sensors and a timeline field, wherein information presented in the one or more fields that correspond to the one or more sensors is synchronized to a common timeline displayed in the timeline field.

10. The system of claim 9, wherein the graphical user interface includes one or more fields configured to receive entry and/or selection of one or more observations made by the user based on the information presented to the user, the one or more physical computer processors configured to associate the observations with the first vehicle event record, the one or more physical computer processors configured to filter the observations based on geo-fences, wherein geo-fences are virtual boundaries that define physical areas where one or more rail vehicle events are permissible or are not permissible.

11. The system of claim 9, wherein the one or more physical computer processors are configured to cause the graphical user interface to present information to a non-rail vehicle operator user in real-time or near real-time during operation of the rail vehicle.

12. The system of claim 9, wherein the graphical user interface includes a geographic map field configured to display a geographic location of the rail vehicle during the first rail vehicle event on a map.

13. The system of claim 9, wherein the one or more physical computer processor are configured such that the analysis includes a determination of a rail vehicle passenger comfort score, and wherein the graphical user interface includes a rail vehicle passenger comfort score field configured to display the determined rail vehicle passenger comfort score.

14. The system of claim 1, wherein the one or more sensors include a video camera configured to acquire visual information that represents an environment about the rail vehicle, the environment about the rail vehicle including areas in or near an interior and an exterior of the rail vehicle, and wherein the one or more physical computer processors are configured such that the analysis includes detecting presence of pedestrians near the exterior of the rail vehicle based on the acquired visual information.

15. The system of claim 1, wherein the one or more physical computer processors are further configured to:

receive rail vehicle location information that indicates a physical geographic location of the rail vehicle from one or more system location sensors that are coupled with the rail vehicle and/or one or more non-system location sensors that are not coupled with the rail vehicle, and synchronize the rail vehicle location information with the first operation information and the second operation information.

16. A method for facilitating analysis of rail vehicle events, the method comprising:

receiving, by one or more physical computer processors executing computer-readable instructions, rail vehicle operation information via output signals generated by sensors coupled with a rail vehicle, the sensors including a first sensor that generates a first output signal conveying first operation information, and a second sensor that generates a second output signal conveying second operation information, wherein the first output signal is associated with first timing information, and wherein the second output signal is associated with second timing information;

obtaining rail vehicle event information defining a first rail vehicle event, the first rail vehicle event having a start time and an end time;

detecting the start time of the first rail vehicle event in the first operation information, wherein the first timing information includes a first time-stamp that indicates the start time of the first rail vehicle event in the first operation information;

detecting the start time of the first rail vehicle event in the second operation information, wherein the second timing information includes a second time-stamp that indicates the start time of the first rail vehicle event in the second operation information, and wherein the first time-stamp does not coincide with the second time-stamp; and synchronizing the first operation information and the second operation information based on analysis of the first time-stamp and the second time-stamp, wherein synchronizing includes identifying and correlating corresponding phenomena in the first output signal and the second output signal during the first rail vehicle event.

17. A rail vehicle event analysis system comprising one or more physical computer processors configured to store in electronic storage computer readable instructions to:

receive a first output signal generated by a first sensor coupled with a rail vehicle, wherein the first output signal conveys a first parameter pertaining to movement of the rail vehicle, wherein the first output signal is associated with first timing information;

receive a second output signal generated by a second sensor coupled with the rail vehicle, wherein the second output signal conveys a second parameter pertaining to actions performed by a vehicle operator of the rail vehicle, wherein the second output signal is associated with second timing information;

detect a first rail vehicle event based on the first parameter, wherein a first start time of the first rail vehicle event is indicated by a first time-stamp in the first timing information;

detect a second rail vehicle event based on the second parameter, wherein a second start time of the second rail vehicle event is indicated by a second time-stamp in the second timing information, wherein the first rail vehicle event is the same as the second rail vehicle event, and wherein the first time-stamp does not coincide with the second time-stamp; and synchronize the first parameter and the second parameter based on analysis of the first time-stamp and the second time-stamp, wherein synchronizing includes identifying and correlating corresponding phenomena in the first output signal and the second output signal during the first and second rail vehicle event.

* * * * *